US008340322B2

(12) United States Patent
Katayama et al.

(10) Patent No.: US 8,340,322 B2
(45) Date of Patent: Dec. 25, 2012

(54) ACOUSTIC PROCESSING DEVICE

(75) Inventors: Masaki Katayama, Hamamatsu (JP); Tomoko Ninomiya, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 8 days.

(21) Appl. No.: 12/879,508

(22) Filed: Sep. 10, 2010

(65) Prior Publication Data

US 2011/0064243 A1 Mar. 17, 2011

(30) Foreign Application Priority Data

Sep. 11, 2009 (JP) ..... 2009-210930

(51) Int. Cl.
*H04R 5/00* (2006.01)

(52) U.S. Cl. ..... 381/97; 381/1; 381/17

(58) Field of Classification Search ..... 381/1, 17, 381/18, 300, 310, 80, 89, 309, 97, 61, 63
See application file for complete search history.

(56) References Cited

U.S. PATENT DOCUMENTS

| | | | | |
|---|---|---|---|---|
| 6,771,778 | B2 * | 8/2004 | Kirkeby | 381/17 |
| 6,804,358 | B1 * | 10/2004 | Kawano | 381/17 |
| 2004/0136554 | A1 * | 7/2004 | Kirkeby | 381/309 |
| 2006/0115090 | A1 * | 6/2006 | Kirkeby | 381/17 |
| 2007/0076892 | A1 * | 4/2007 | Kim | 381/17 |
| 2008/0031462 | A1 * | 2/2008 | Walsh et al. | 381/17 |

FOREIGN PATENT DOCUMENTS

JP 10-28097 A 1/1998

* cited by examiner

*Primary Examiner* — Xu Mei
*Assistant Examiner* — David Ton
(74) *Attorney, Agent, or Firm* — Crowell & Moring LLP

(57) ABSTRACT

An acoustic processing device includes an input section to which audio signals of a plurality of channels respectively including in-phase components are input, a phase adjusting section that adjusts phases of the audio signals of the plurality of channels respectively to generate phase adjustment signals of the plurality of channels being different in phase from the audio signals of the plurality of channels input to the input section, an anti-phase generating section that generates an anti-phase signal by adding the phase adjustment signals of the plurality of channels to each other and adjusting a phase of the added signal to a substantially inverted phase, and an output section that outputs signals obtained by adding, to each of the audio signals of the plurality of channels input to the input section, the phase adjustment signal of another channel and the anti-phase signal.

5 Claims, 9 Drawing Sheets

ACOUSTIC PROCESSING DEVICE

BACKGROUND

The present invention relates to a technique to improve sound through addition processing of a plurality of sound signals.

Recently, most of sound reproducing devices for stereophonically reproducing music or the like have compact housings for improving the portability and the space saving property. In a compact sound reproducing device, a distance between two speakers for an L-channel and an R-channel is so small that differences in time and level between sounds output from the two speakers and reaching respective ears of a person are small, and hence, expansion of a resultant sound field is poor.

As a conventional countermeasure, an acoustic processing technique for improving the expansion of a sound field by adding, to a signal of a given channel, an anti-phase component (an indirect path component) of a signal of the opposite channel before outputting a resultant sound from a speaker has been disclosed (see, for example, JP-A-10-028097).

In sound signals of music or the like to be reproduced by a sound reproducing device, sound of vocals or the like is included in sound signals of the L-channel and R-channel as in-phase components so that its sound image may be localized in the center in stereophonic reproduction. However, when an anti-phase component of a sound signal of the R-channel (or the L-channel) is added to a sound signal of the L-channel (or the R-channel) on the opposite side, the in-phase components included in the sound signals of the L-channel and the R-channel interfere with each other to be degraded, resulting in causing a problem that the density of a sound image obtained in the center is lowered. For example, when music is reproduced with a conventional stereophonic reproducing device, although a sound field is expanded in the lateral direction, vocal sounds localized in the center may be sometimes difficult to be heard.

SUMMARY

Therefore, an object of the invention is to provide an acoustic processing device for preventing degradation of in-phase components included in a plurality of sound signals.

In order to achieve the above object, according to the present invention, there is provided an acoustic processing device comprising:

an input section to which audio signals of a plurality of channels respectively including in-phase components are input;

a phase adjusting section that adjusts phases of the audio signals of the plurality of channels respectively to generate phase adjustment signals of the plurality of channels being different in phase from the audio signals of the plurality of channels input to the input section;

an anti-phase generating section that generates an anti-phase signal by adding the phase adjustment signals of the plurality of channels to each other and adjusting a phase of the added signal to a substantially inverted phase; and an output section that outputs signals obtained by adding, to each of the audio signals of the plurality of channels input to the input section, the phase adjustment signal of another channel and the anti-phase signal.

Preferably, the acoustic processing device further includes a filtering section that makes a dip in each of the audio signals of the plurality of channels input to the input section in a range from 4 kHz to 8 kHz and outputs resultant signals to the phase adjusting section.

Preferably, the filtering section includes a delaying section which delays each of the audio signals of the plurality of channels by a previously set time, and an adding section which outputs signals obtained by adding the audio signals of the plurality of channels delayed by the delaying section and the audio signal of the plurality of channel input to the input section respectively in the same channel.

Preferably, the acoustic processing device further includes a compensating section that compensates a dip of a component of the anti-phase signal in each of the signals output by the output section.

Preferably, the phase adjusting section adjusts the phases of the audio signals of the plurality of channels respectively with same amount of phase adjustment.

Preferably, the phase adjusting section adjusts the phases of the audio signals of the plurality of channels respectively with different amounts of phase adjustment.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

A stereophonic reproducing device will now be described as an embodiment of the acoustic processing device of the invention.

Figure 1:
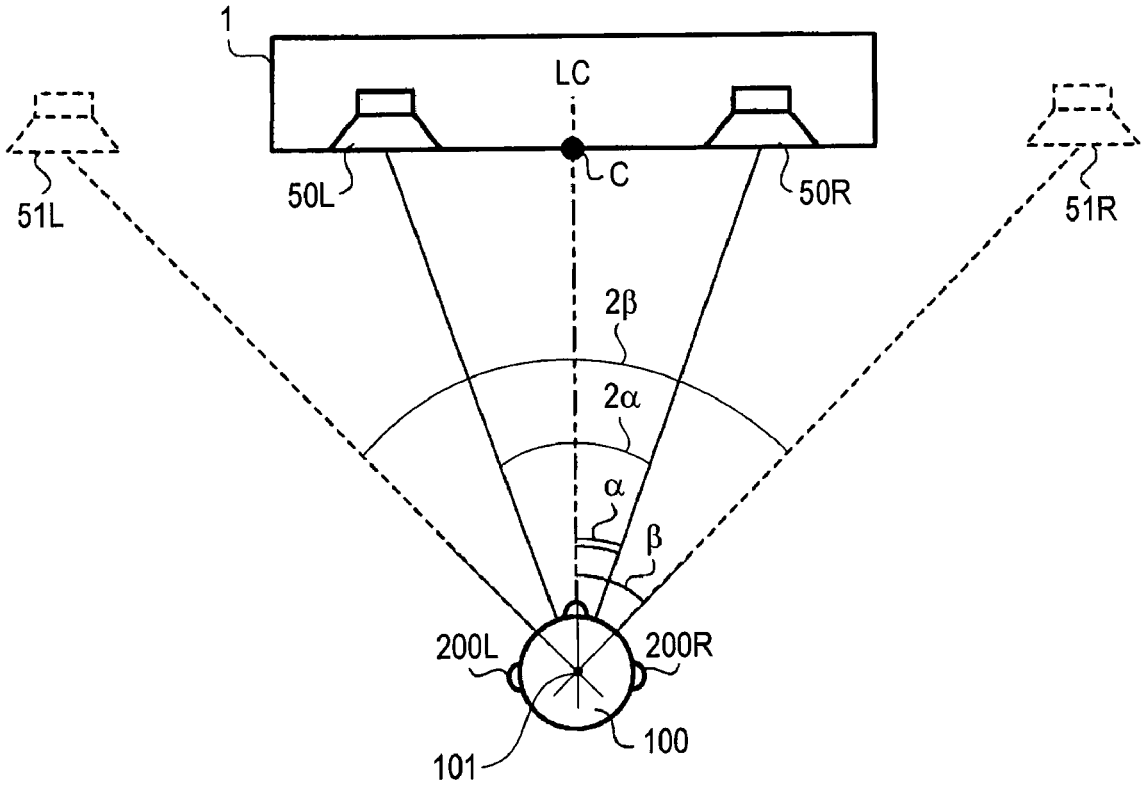
FIG. 1 is a diagram taken from above (plan view) illustrating the relationship in the position between speakers of a speaker apparatus according to an embodiment and a listener.
Figure 2A:
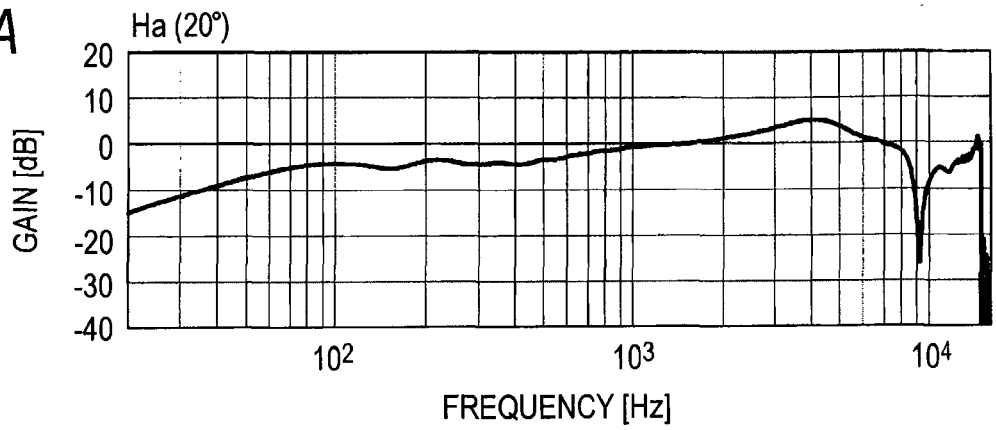
FIG. 2A is a diagram illustrating a frequency characteristic of an HRTF of a direct path obtained when $\beta=20°$.
Figure 2B:
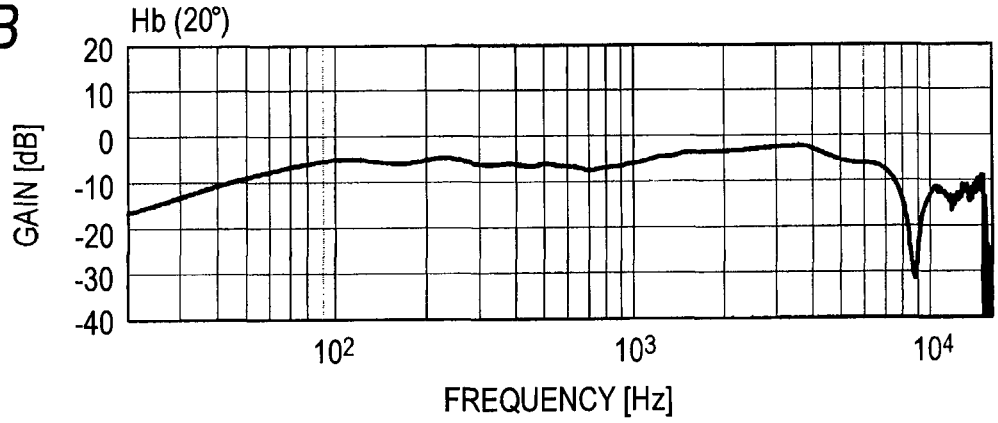
FIG. 2B is a diagram illustrating a frequency characteristic of an HRTF of an indirect path obtained when $\beta=20°$.
Figure 2C:
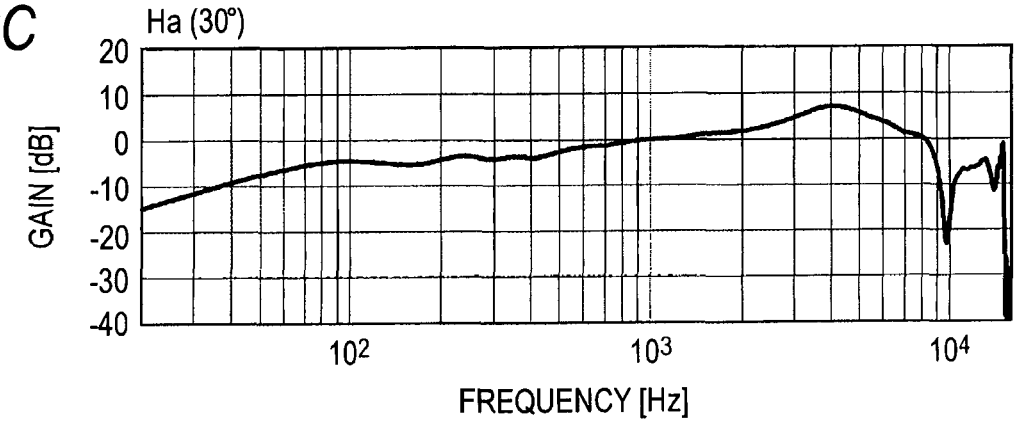
FIG. 2C is a diagram illustrating a frequency characteristic of an HRTF of a direct path obtained when $\beta=30°$ and FIG. 2D is a diagram illustrating a frequency characteristic of an HRTF of an indirect path obtained when $\beta=30°$.
Figure 2D:
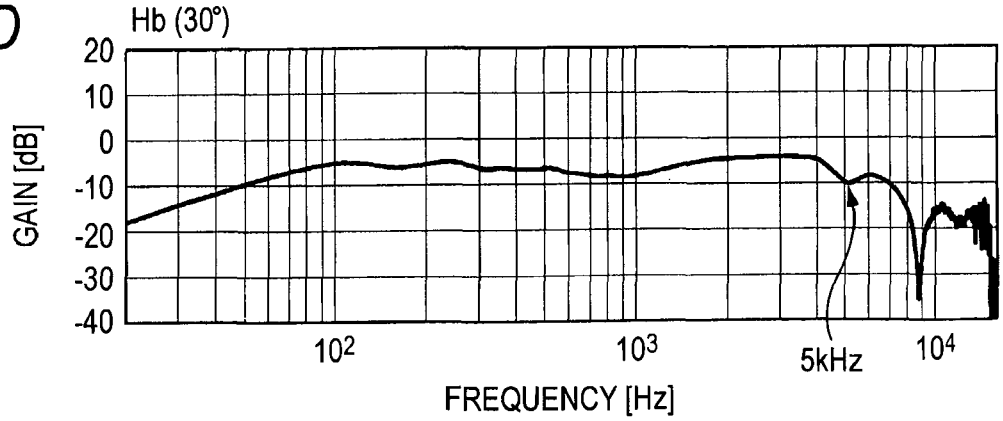
Figure 3A:
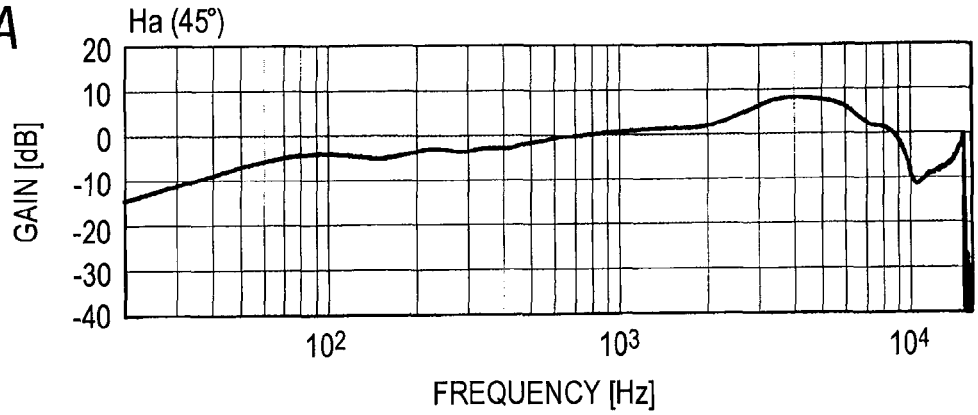
FIG. 3A is a diagram illustrating a frequency characteristic of an HRTF of a direct path obtained when $\beta=45°$.
Figure 3B:
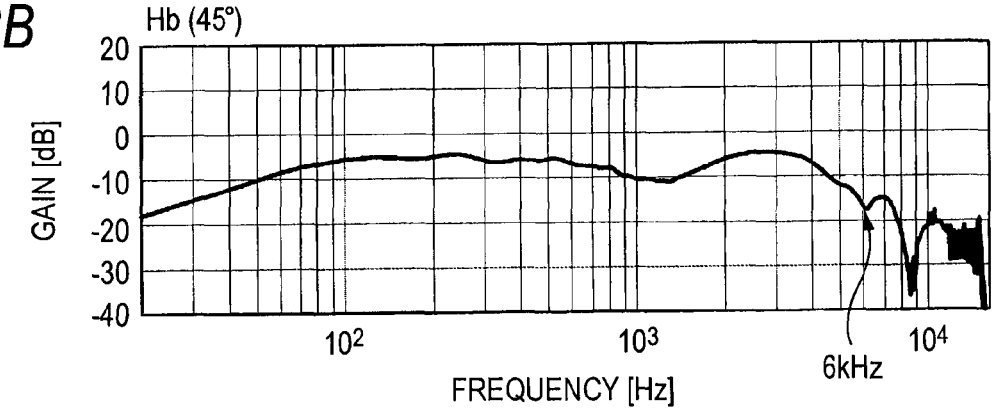
FIG. 3B is a diagram illustrating a frequency characteristic of an HRTF of an indirect path obtained when $\beta=45°$.
Figure 3C:
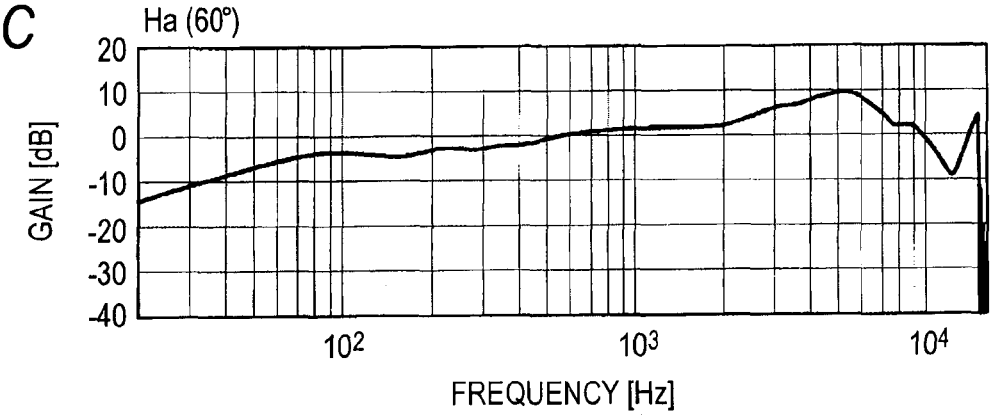
FIG. 3C is a diagram illustrating a frequency characteristic of an HRTF of a direct path obtained when $\beta=60°$ and FIG. 3D is a diagram illustrating a frequency characteristic of an HRTF of an indirect path obtained when $\beta=60°$.
Figure 3D:
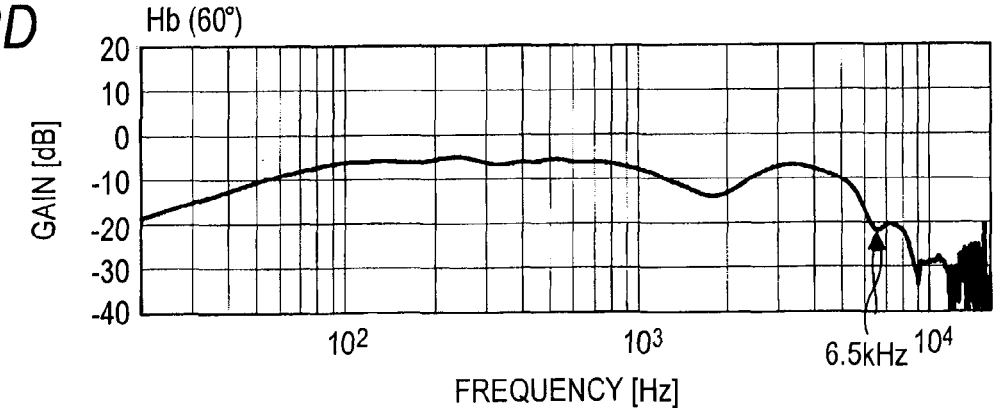

As illustrated in FIG. 1, the stereophonic reproducing device 1 according to an embodiment of the invention includes two speakers 50L and 50R. The speakers 50L and 50R are provided in positions spaced by an equal distance from the center C of a front panel of the stereophonic reproducing device 1. The stereophonic reproducing device 1 outputs, from the speakers 50L and 50R, stereophonic sounds in accordance with audio signals input from another device not shown. A listener 100 may feel a stereophonic sound field when he/she hears sounds reproduced by the stereophonic reproducing device 1 in a listener position 101 corresponding to an arbitrary position on a center line LC passing through the center C. Herein, an angle of a straight line connecting the listener position 101 and the speaker 50R against the center line LC is designated as an angle $\alpha$ and an angle of a straight line connecting the listener position 101 and a virtual speaker 51R against the center line LC is designated as an angle $\beta$. In the following description, it is assumed that the angle $\alpha$<the angle $\beta$.

The stereophonic reproducing device 1 subjects an audio signal to acoustic processing, so as to output sounds (audio sounds) for making the listener 100 feel as if a sound image formed by the speakers 50L and 50R close to each other (disposed at an angle on one side of the center line of $\alpha$ and a whole speaker angle of $2\beta$ were expanded to a position obtained by virtual speakers 51L and 51R (disposed at an angle on one side of the center line of $\beta$ and a whole speaker angle of $2\beta$) as illustrated with dotted lines.

First, conventional acoustic processing for expanding a sound image position by a binaural reproducing technique using an HRTF will be simply explained before describing the configuration of the stereophonic reproducing device 1 employed for realizing acoustic processing of this embodiment of the invention.

In employing the binaural reproducing technique, a head-related transfer function (hereinafter designated as an HRTF) from a speaker actually installed in a position desired to be virtually localized to a right ear 200R or a left ear 200L is obtained. An HRTF is obtained by any of known methods such as a method using a dummy head. Herein, an HRTF of a direct path from the speaker 50R localized at the angle $\alpha$ to the right ear 200R is designated as $Ha(\beta)$ and an HRTF of an indirect path from the speaker 50R to the left ear 200L is designated as $Hb(\alpha)$. Also, an HRTF of a direct path from the virtual speaker 51R localized at the angle $\beta$ to the right ear 200R is designated as $Ha(\beta)$ and an HRTF of an indirect path from the virtual speaker 51R to the left ear 200L is designated as $Hb(\beta)$.

Also, as described above, the speakers 50R and 50L are provided in the positions spaced by the equal distance from the center C. Furthermore, the virtual speakers 51R and 51L are localized in positions spaced by an equal distance from the center C. Therefore, HRTFs of paths from the speakers 50L and 51L to the respective ears are the same as those of the speakers 50R and 51R, and hence, there is no need to obtain these HRTFs.

Next, a difference between $Ha(\alpha)$ and $Ha(\beta)$ corresponding to the HRTFs of the direct paths (i.e., $Ha(\beta)-Ha(\alpha)$ in using a unit of dB) is convolved in an R-channel audio signal and an L-channel audio signal. Also, a difference between $Hb(\alpha)$ and $Hb(\beta)$ corresponding to the HRTFs of the indirect paths (i.e., $Hb(\beta)-Hb(\alpha)$ in using a unit of dB) is convolved in the R-channel audio signal and the L-channel audio signal.

Then, the R-channel audio signal in which the difference between the HRTFs of the direct paths has been convolved and the L-channel audio signal in which the difference between the HRTFs of the indirect paths has been convolved are added to each other, so as to release a resultant sound from the speaker 50R. Also, the L-channel audio signal in which the difference between the HRTFs of the direct paths has been convolved and the R-channel audio signal in which the difference between the HRTFs of the indirect paths has been convolved are added to each other, so as to output a resultant sound from the speaker 50L.

In this manner, the listener 100 may feel the sound output from the speaker 50R as a sound output from the virtual speaker 51R and the sound output from the speaker 50L as a sound output from the virtual speaker 51L.

The present inventors have analyzed the frequency characteristics of HRTFs and conducted experiments on sound image localization. As a result, it has been found that a listener feels as if virtual speakers were localized in positions at an angle of 30° through 60° when a sound of an indirect path has a dip in a frequency range from 4 kHz to 8 kHz. It has been also found that this phenomenon does not depend upon race, sex and age. Furthermore, it has been found that the angle of a sound image to be felt is larger as the center frequency of the dip is higher.

As illustrated in FIGS. 2A to 2D and 3A to 3D, when the angle $\beta$ is 30°, 45° and 60° with respect to $Hb(\beta)$ there are respectively dips with the center frequencies of 5 kHz, 6 kHz and 6.5 kHz. On the other hand, when the angle $\beta$ is 20° with respect to $Hb(\beta)$, there is no remarkable dip in a frequency band of 8 kHz or less.

Incidentally, since such a dip has a given half width, dips are distributed in a range from approximately 4 kHz to approximately 8 kHz. The upper limit is 8 kHz because there is a large dip in a frequency band of 8 kHz or more regardless of the angle $\beta$ and the influence of the dip on the sound image localization seems to be small in the frequency band of 8 kHz or more. On the other hand, the lower limit is 4 kHz because there is a dip in a range of 5 kHz±1 kHz when the angle $\beta$ is 30° but there is no remarkable dip in this frequency range when the angle $\beta$ is 20° or less. Accordingly, it seems that a dip caused in this frequency range largely affects the expansion of the sound image localization. Incidentally, although a frequency characteristic obtained when the angle $\beta$ is smaller than 20° is not illustrated in drawings, it is substantially the same as that obtained when the angle $\beta$ is 20°.

The stereophonic reproducing device 1 according to the embodiment of the invention simply realizes acoustic processing similar to that using HRTFs by applying the aforementioned results of the analysis and the experiments obtained by the present Applicant. Now, the configuration of the stereophonic reproducing device 1 according to the embodiment of the invention will be described.

Figure 4:
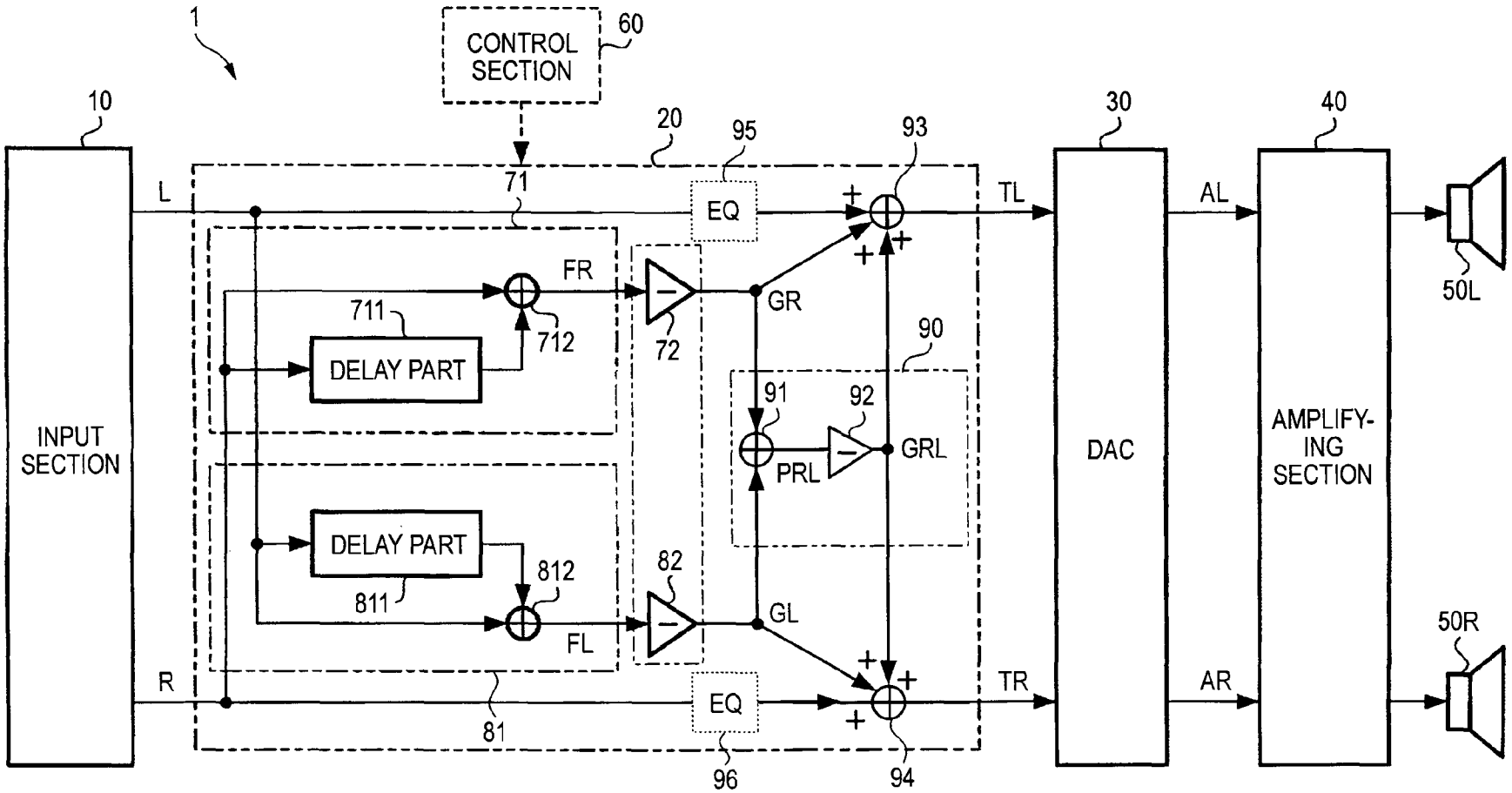
FIG. 4 is a block diagram illustrating the configuration of a stereophonic reproducing device according to the embodiment.

As illustrated in FIG. 4, the stereophonic reproducing device 1 includes an input section 10, an acoustic processing section 20, a D/A converter 30 (hereinafter referred to as the DAC 30), an amplifying section 40 and the speakers 50R and 50L. The acoustic processing section 20 corresponds to the acoustic processing device of the invention.

The acoustic processing section 20 includes a comb filter 71, an amplifier 72, a comb filter 81, an amplifier 82, an anti-phase generating section 90, an equalizer 95 and an equalizer 96.

A digital audio signal output from a DIR (digital interface receiver), an ADC (analog-digital converter) or the like not shown is input to the input section 10. The input section 10 decodes the input audio signal and outputs the decoded signal to the acoustic processing section 20.

Such audio signals input to the acoustic processing section 20 are audio signals of stereophonic two channels and include a sound to be localized in the center. Specifically, the audio signals are an R-channel audio signal including a C-channel audio signal and an L-channel audio signal including the C-channel audio signal. The C-channel audio signal is included as an in-phase component in the R-channel audio signal and the L-channel audio signal. Hereinafter, the L-channel audio signal is designated as an audio signal L, the R-channel audio signal is designated as an audio signal R and the C-channel audio signal is designated as an audio signal C. Furthermore, the sampling frequency of the audio signal L and the audio signal R is, for example, 48 kHz.

The comb filter 71 includes a delay part 711 and an addition part 712, and outputs an audio signal FR obtained by performing filtering processing with a given frequency characteristic on the audio signal R input thereto.

The delay part 711 performs delay processing with a previously set delay time on the input audio signal R. In the delay processing of this exemplary case, delay corresponding to 4 samples of the audio signal R is caused. The delay time is approximately 83.3 microseconds when the sampling frequency is 48 kHz. The addition part 712 adds the audio signal R having been subjected to the delay processing by the delay part 711 to the audio signal R input from the input section 10 so as to output the audio signal FR.

Figure 5:
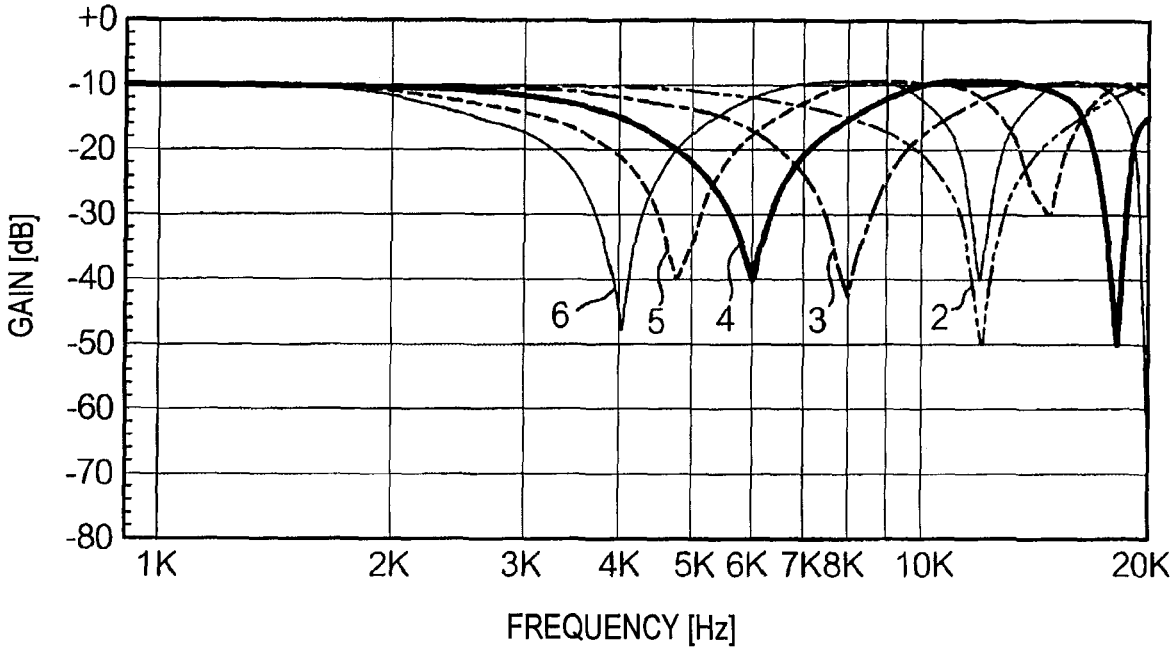
FIG. 5 is an explanatory diagram of a frequency characteristic of a comb filter used in the embodiment.

At this point, the relationship in the comb filter 71 between the delay time set in the delay part 711 and the frequency characteristic of the filter will be described with reference to FIG. 5. In FIG. 5, each numerical value illustrated in the vicinity of each frequency characteristic corresponds to the number of samples set as the delay time. The frequency characteristic of a comb filter has a dip in a prescribed frequency range and the center frequency of the dip depends upon the delay time. The center frequency of a dip in the frequency characteristic of a comb filter is obtained in accordance with the following Expression 1:

$$DFn=(2n-1)/2Td \qquad \text{Expression 1}$$

In Expression 1, DFn indicates the center frequency (Hz) of a dip, Td indicates delay time (in seconds) set in the delay part 711, and n is a natural number.

When the sampling frequency is 48 kHz and the delay time Td corresponds to 4 samples (i.e., is approximately 83.3 microseconds) as in this exemplary case, the lowermost frequency DF1 in the frequency of the dip is 6 kHz. It is noted that when the delay time Td corresponds to 2 samples, 3 samples, 4 samples, 5 samples and 6 samples, the lowermost frequencies DF1 of dips in the frequency characteristics are respectively approximately 12 kHz, 8 kHz, 6 kHz, 4.8 kHz and 4 kHz.

When there is a dip in the frequency range from 4 kHz to 8 kHz in the frequency characteristic of the HRTF of an indirect path as described above, a listener may be made to definitely feel localization of virtual speakers in positions expanded beyond the actual positions of the speakers. Furthermore, if the lowermost frequency DF1 of the dip is out of the aforementioned frequency range, it is difficult to make a listener definitely feel localization of virtual speakers in expanded positions. Accordingly, in the delay part 711, the delay time Td is set to fall in a range from 62.5 microseconds to 125 microseconds (which corresponds to a range from 3 samples to 6 samples when the number of samples is used for the range definition as in this exemplary case) so that the lowermost frequency DF1 of the dip in the frequency characteristic may fall in the range from 4 kHz to 8 kHz.

Incidentally, since such a dip has a given half width, when the delay time Td is set to fall in a range from 77 microseconds to 100 microseconds in accordance with the range of the center frequency of the dip in the HRTF (namely, the range from 5 kHz to 6.5 kHz correspondingly to the angle β of 30° through)60°, the effect to expand the sound image localization may be more definitely attained. In this case, when the number of samples is used for the range definition, the range corresponds to 4 samples alone, but when the sampling frequency of the audio signals L and R is high or when an oversampling processing section for increasing the sampling frequency by oversampling the audio signals L and R input to the acoustic processing section 20 is provided, the delay time Td may be finely adjusted within the set range.

In this exemplary case, the comb filter 71 subjects the input audio signal R to the filtering processing with a frequency characteristic having the center frequency of a dip of 6 kHz, and therefore, the audio signal FR to be output has a frequency distribution in which the output level in the vicinity of 6 kHz is lowered as compared with that in the audio signal R.

The comb filter 81 includes a delay part 811 and an addition part 812, and performs filtering processing with a prescribed frequency characteristic on the audio signal L input thereto and outputs a resultant signal as an audio signal FL. The configuration of the comb filter 81 is the same as that of the comb filter 71 and hence the detailed description is herein omitted. It is noted that the comb filters 71 and 81 correspond to a filtering section of the invention.

The amplifier 72 is an inverting amplifier, which amplifies the audio signal FR input from the comb filter 71 with a previously set amplification factor, adjusts its output level and inverts its phase (changes the phase to opposite), so as to output an audio signal GR. The amplifier 82 is an inverting amplifier, which amplifies the audio signal FL input from the comb filter 81 with a previously set amplification factor, adjusts its output level and inverts its phase (changes the phase to opposite), so as to output an audio signal GL. This processing of the amplifiers 72 and 82 is performed for adjusting a level difference between the dip resulting from the filtering processing performed by the comb filter 71 or the comb filter 81 and the dip caused in the difference between the HRTFs. In this exemplary case, the amplification factor is set so as to perform the adjustment in accordance with a level corresponding to the difference between Hb(α) and Hb(β). It is noted that this level adjustment slightly affects the sound image localization, and hence, there is no need to precisely adjust the level in accordance with the difference between the HRTFs as far as the level difference is not too large. Incidentally, the amplifiers 72 and 82 are set to have the same amplification factor. It is noted that the amplifiers 72 and 82 correspond to a phase adjusting section of the invention. Also, the signals output from the amplifiers 72 and 82 correspond to phase adjustment signals.

The anti-phase generating section 90 includes an adder 91 and an amplifier 92.

The adder 91 adds the audio signal GR obtained through the amplification and the phase shift (the phase change to opposite) performed by the amplifier 72 to the audio signal GL obtained through the amplification and the phase shift (the phase change to opposite) performed by the amplifier 82, so as to output an audio signal PRL.

The amplifier 92 is an inverting amplifier, which amplifies the audio signal PRL input from the adder 91 with a previously set amplification factor, adjusts its output level and inverts its phase (changes the phase to opposite), so as to output an audio signal GRL (corresponding to an anti-phase signal of the invention). The amplification factor of the amplifier 92 is set to, for example, – (minus) 0.5.

In the signal generated by adding the audio signal GL and the audio signal GR and amplifying the resultant by –0.5 by the adder 91 and the amplifier 92, a component of the audio signal C in the audio signal GRL is shifted to opposite in the phase and has the same level with respect to a component of the audio signal C in the audio signal GL and the audio signal GR.

Figure 6:
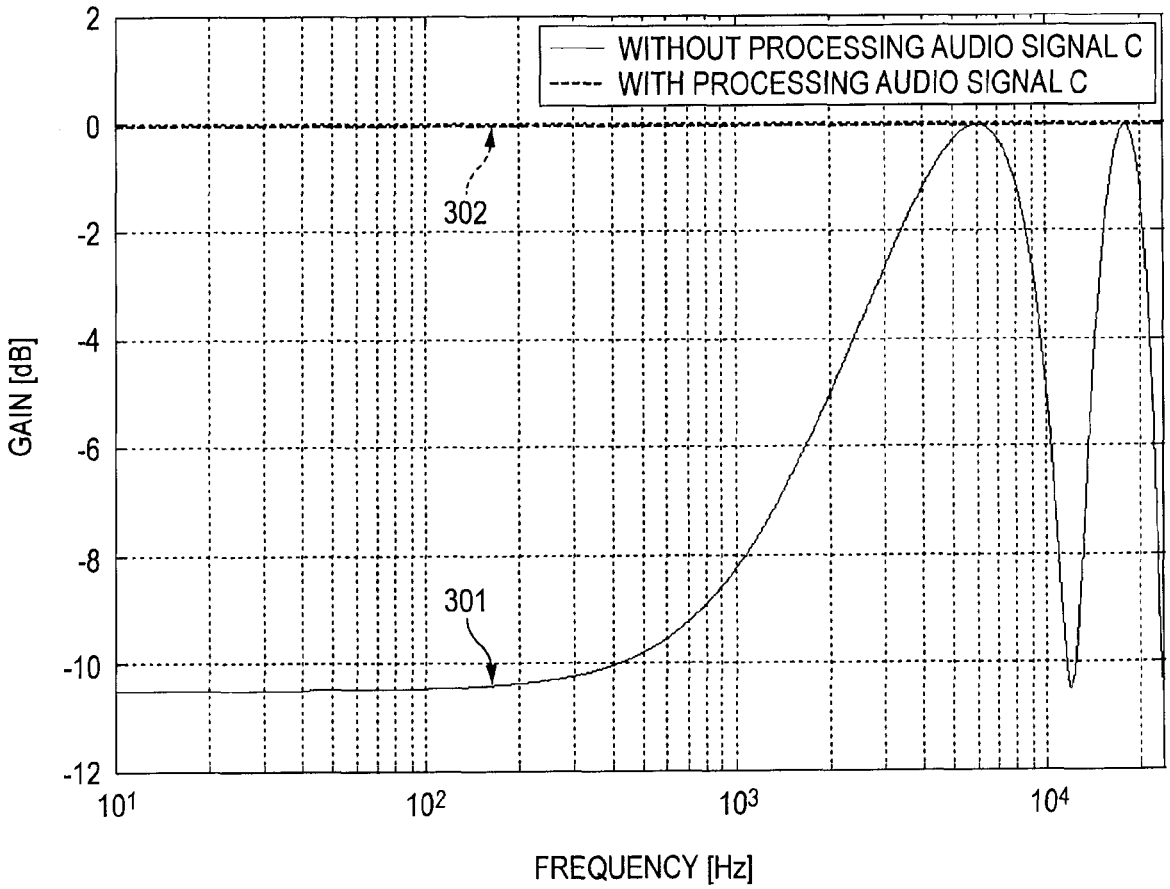
FIG. 6 is a diagram illustrating frequency characteristics of in-phase components obtained with or without an anti-phase generating section.

The adder 93 adds the audio signal L including the audio signal C, the audio signal GR including the audio signal C having been amplified and shifted in the phase by the amplifier 72 (i.e., the indirect path component of the audio signal R) and the audio signal GRL having been amplified and shifted in the phase by the amplifier 92 to one another, so as to output an audio signal TL. When the audio signal L and the audio signal GR are added to each other, the audio signal C included in the audio signal L and the audio signal C included in the audio signal GR interfere with each other and cancel each other. Therefore, if the anti-phase generating section 90 is not provided, the audio signal C is degraded as illustrated in FIG. 6 as a frequency characteristic 301. Since the audio signal GRL is further added by the adder 93, however, the audio signal C in the same quantity as that included in the audio signal GR is further added, and thus, the audio signal C can be included in the audio signal TL. Similarly, the audio signal GRL is further added by the adder 94, and hence, the audio signal C can be included in the audio signal TR. Accordingly, since the anti-phase generating section 90 is provided, the audio signal C included (as the in-phase component) in the audio signal L and the audio signal C included (as the in-phase component) in the audio signal R may be prevented from degrading as illustrated in FIG. 6 as a frequency characteristic 302. It is noted that the adders 93 and 94 correspond to an output section of the invention.

Figure 7:
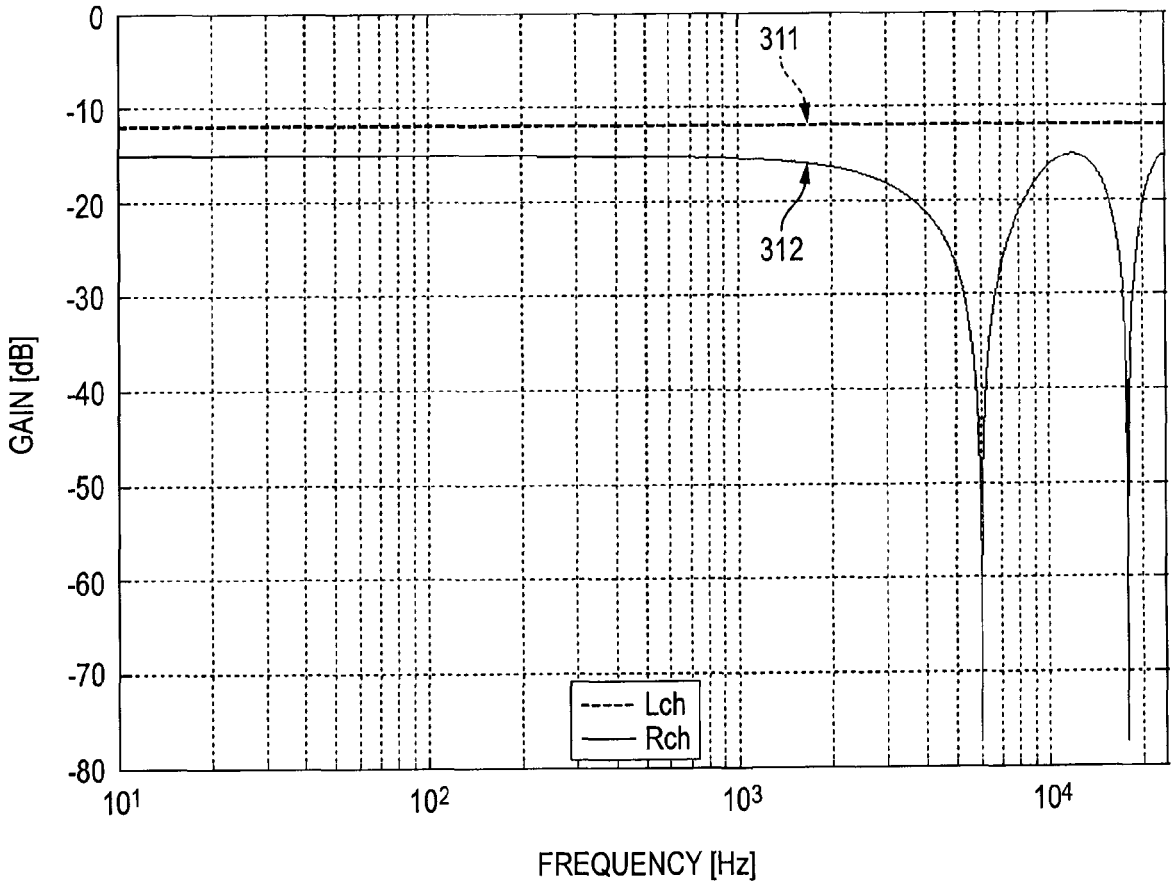
FIG. 7 is a diagram illustrating frequency characteristics of a direct path component of an L-channel and an indirect path component of an R-channel included in an output signal of the anti-phase generating section in response to input of an L-channel signal when a C-channel audio signal component is not included.
Figure 8:
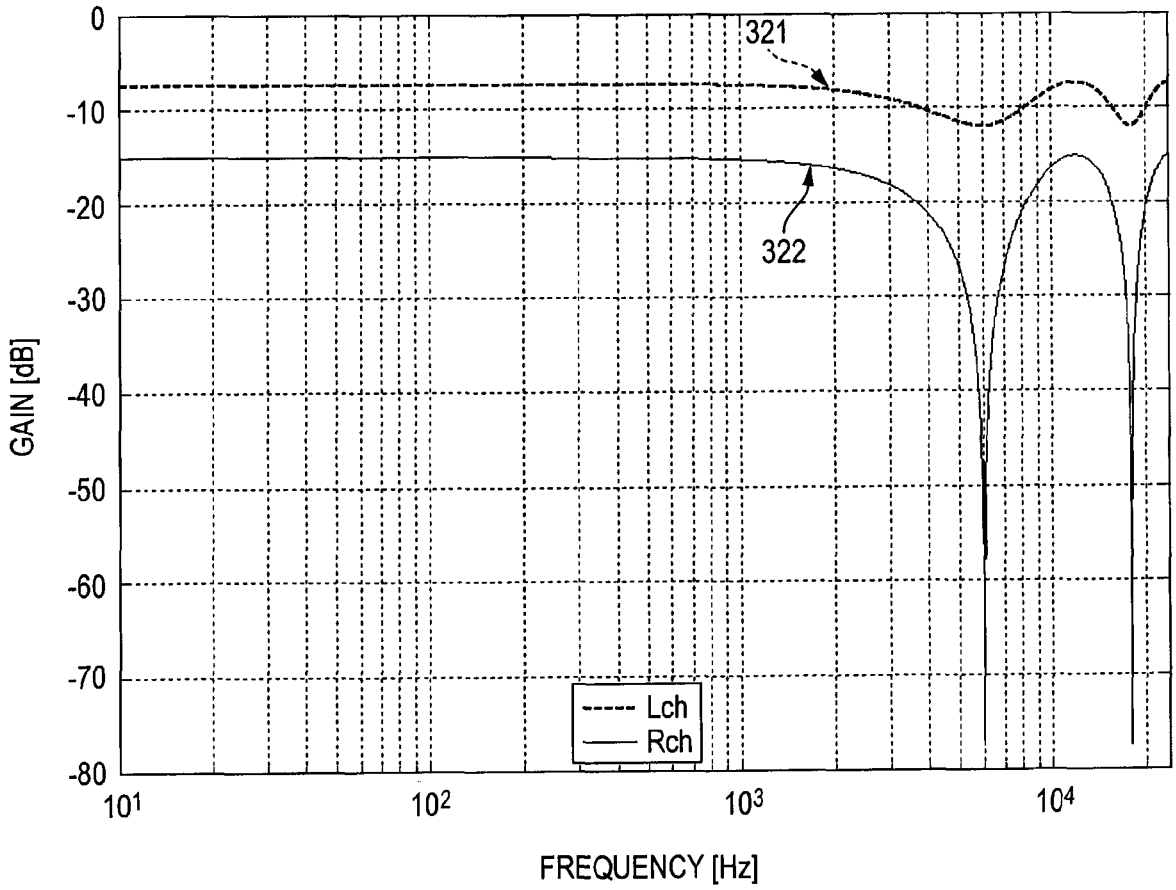
FIG. 8 is a diagram illustrating frequency characteristics of a direct path component of an L-channel and an indirect path component of an R-channel included in an output signal of the anti-phase generating section in response to input of an L-channel signal when a C-channel audio signal component is included.

When the aforementioned processing is performed in the anti-phase generating section 90, the indirect path component of the audio signal R included in the audio signal TL is not changed in its frequency characteristic as illustrated as a frequency characteristic 312 in FIG. 7 and a frequency characteristic 322 in FIG. 8. This is because the audio signal GR and the audio signal GRL having completely the same frequency characteristic are added to each other by the adder 93. Similarly with respect to the audio signal TR, the indirect path component of the audio signal L is not changed in its frequency characteristic.

On the other hand, when the aforementioned processing is performed in the anti-phase generating section 90, the direct path component of the audio signal R included in the audio signal TL is changed in its frequency characteristic as illustrated as a frequency characteristic 311 in FIG. 7 and a frequency characteristic 321 in FIG. 8. This is because the audio signal L (the direct path component) input from the input section 10 and the audio signal L (the indirect path component (having the dip at 6 kHz)) included in the audio signal GRL are added to each other by the adder 93. Also the direct path component of the audio signal R included in the audio signal TR is similarly changed in its frequency characteristic. Although influence of such change in the frequency characteristic is small, the change in the frequency characteristic may be compensated by employing the following configuration:

When the change in the frequency characteristic is to be compensated, the equalizer 95 is provided between the input section 10 and the adder 93, so as to perform compensation for eliminating a dip of the component of the audio signal L from the audio signal TL output from the adder 93. Furthermore, the equalizer 96 is provided between the input section 10 and the adder 94, so as to perform compensation for eliminating a dip of the component of the audio signal R from the audio signal TR output from the adder 94. In other words, the equalizer 95 compensates change in the frequency characteristic in a range from 4 kHz to 8 kHz with respect to the direct path component of the audio signal L. Also, the equalizer 96 compensates change in the frequency characteristic in a range from 4 kHz to 8 kHz with respect to the direct path component of the audio signal R. As a result, the audio signal TL output from the adder 93 attains a characteristic as illustrated in FIG. 7 as the frequency characteristic 311. The audio signal TR output from the adder 94 attains a similar characteristic in the same manner. It is noted that the equalizers 95 and 96 correspond to a compensating section of the invention.

In this manner, the acoustic processing section 20 subjects the audio signal L and the audio signal R input thereto to the acoustic processing, so as to output the audio signal TL and the audio signal TR.

The DAC 30, that is, a digital-analog converter, performs analog conversion of the digital audio signals TL and TR output from the acoustic processing section 20, so as to output converted signals as an analog audio signal AL and an analog audio signal AR.

The amplifying section 40 is a preamplifier and a power amplifier and amplifies the audio signals AL and AR output from the DAC 30. Then, it outputs the amplified audio signals AL and AR respectively to the speakers 50L and 50R for outputting corresponding sounds.

In this manner, a sound obtained on the basis of the audio signal AL having a dip at 6 kHz in the indirect path component is output from the speaker 50L and a sound obtained on the basis of the audio signal AR having a dip at 6 kHz in the indirect path component is output from the speaker 50R. Therefore, for the listener 100 positioned as illustrated in FIG. 1, a sound image formed by the audio signals AL and AR is localized in a direction at the angle β of 45°. As a result, the listener 100 may feel as if the sounds were output from the virtual speakers 51L and 51R.

As described so far, the stereophonic reproducing device 1 according to the embodiment of the invention carries out the acoustic processing for providing an audio signal of one channel with a dip in the vicinity of a frequency of 4 kHz through 8 kHz and adjusting the phase of the audio signal through the filtering processing with small throughput by employing a simple configuration of the comb filter using delay of several samples, so as to be added to an audio signal of the other channel. Then, a sound is output on the basis of the audio signal resulting from this acoustic processing. Therefore, even when the speakers 50L and 50R of the stereophonic reproducing device 1 are provided to be close to each other and the speaker angle seen from the listener 100 is small, the listener 100 may be made to feel as if sounds were output from the virtual speakers 51L and 51R disposed at a larger speaker angle, and thus, a sound image position may be expanded (changed).

Furthermore, since the comb filter is provided with a frequency characteristic having a dip at a given frequency, the present processing has higher robustness than the conventional processing using HRTFs. Therefore, even a listener having a head in a different shape from that used in obtaining the HRTFs may feel expansion of a sound image position without uncomfortable feeling, and moreover, it is possible to increase a range of the position of a listener where the expansion of the sound image position may be felt.

Furthermore, in the stereophonic reproducing device 1 according to the embodiment of the invention, the anti-phase generating section 90 adds in-phase components of phase adjustment signals of respective channels as anti-phase signals, so as to restore in-phase components otherwise degraded. Also, the indirect path components illustrated in FIGS. 7 and 8 are not changed in their frequency characteristics. Accordingly, the degradation of the in-phase components may be prevented without affecting the expansion of a sound field.

The preferred embodiment of the invention has been described so far, and the invention may be practiced in any of various embodiments including the following:

Although the phase adjustment performed by the amplifier 72 of the acoustic processing section 20 is carried out so as to attain the anti-phase relationship in the aforementioned embodiment, the anti-phase relationship should not be always attained. This phase adjustment is performed for preventing localization between the speakers 50L and 50R owing to correlation between the component of the audio signal L included in the audio signal AL output from the speaker 50L and the component of the audio signal FL included in the audio signal AR output from the speaker 50R. The same is true of the amplifier 82.

Figure 9:
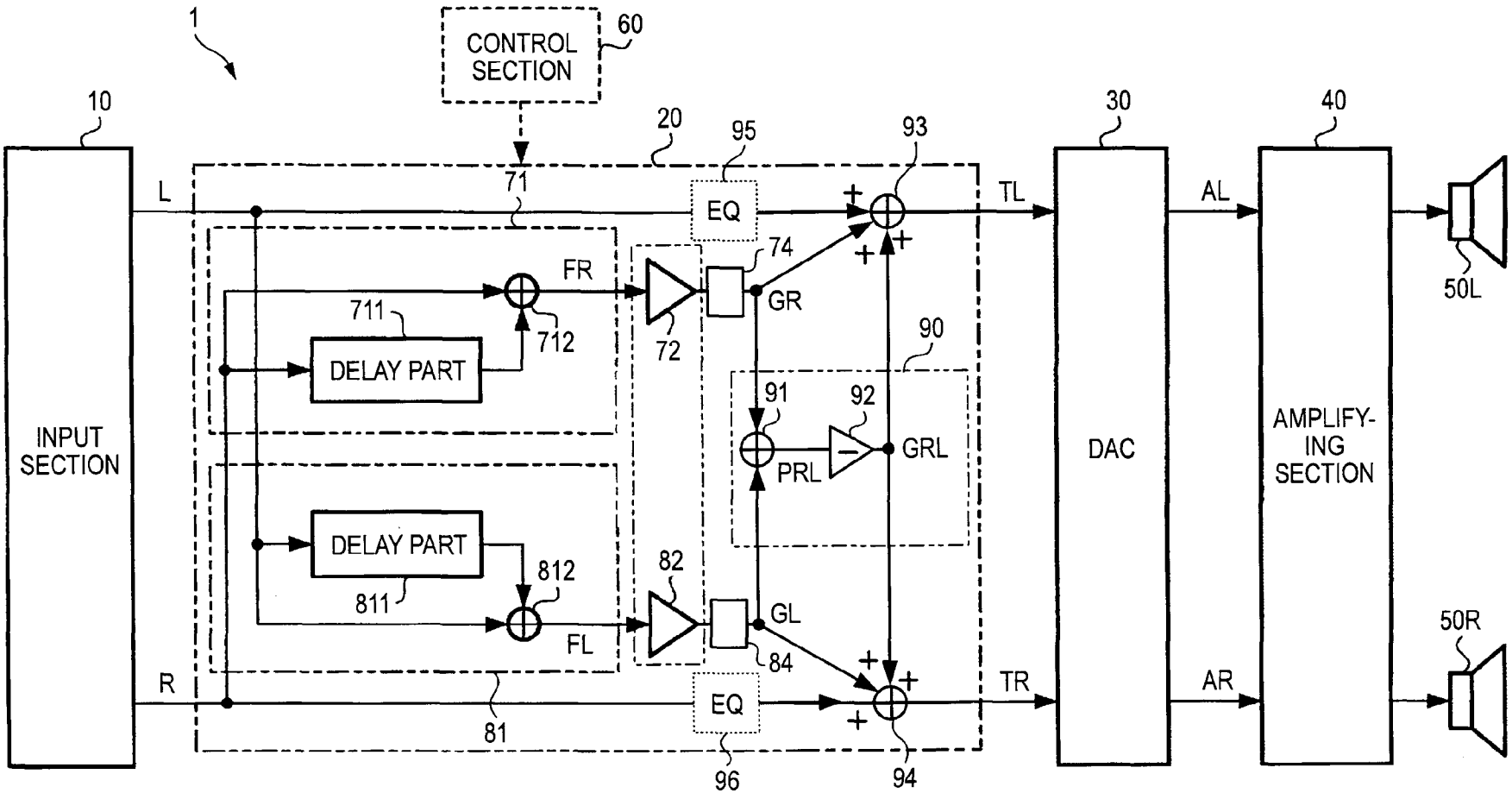
FIG. 9 is a block diagram of a modification of a stereophonic reproducing device of the embodiment.

Such localization may be prevented when a combination of the audio signal L and the audio signal FL and a combination of the audio signal R and the audio signal FR are at least not in an in-phase relationship. The phase is adjusted by using an all-pass filter or the like. For example, as illustrated in FIG. 9, an all-pass filter 74 is provided at a stage following the amplifier 72. Also, an all-pass filter 84 is provided at a stage following the amplifier 82.

The all-pass filter 74 adjusts the phase of the audio signal FR input from the amplifier 72 to be different from that of the audio signal R input to the input section.

The all-pass filter 84 adjusts the phase of the audio signal FL input from the amplifier 82 to be different from that of the audio signal L input to the input section.

In this case, there is no need to invert, in the amplifier 72, the audio signal output from the comb filter 71. Similarly, there is no need to invert, in the amplifier 82, the audio signal output from the comb filter 81. Incidentally, the all-pass filters 74 and 84 correspond to a phase adjusting section of the invention in this case.

In the aforementioned embodiment, the amplifier 92 is the inverting amplifier, and the audio signal PRL is inverts its phase (changes the phase to opposite) in the amplifier 92. However, it is not limited to change the phase of the audio signal PRL to opposite exactly. The amplifier 92 may adjust a phase of the audio signal PRL to substantially 180 degree to obtain an advantage effect, that is, including the audio signal C in the audio signals TL and TR.

In the aforementioned embodiment, the delay time set in the delay parts 711 and 811 of the acoustic processing section 20 may be changed. In this case, a control section 60 is provided as illustrated with a broken line in FIG. 4. This control section 60 determines the delay time to be set in the delay parts 711 and 811 in response to an instruction and sets the determined delay time. This instruction is issued by, for example, the listener 100 through an operation of an operating section not shown, and is an instruction for expanding or narrowing a sound image position. When an instruction for expanding a sound image position is issued, the control section 60 determines the delay time Td as a prescribed time shorter than a currently set time, and when an instruction for narrowing a sound image position is issued, the control section 60 determines the delay time Td as a prescribed time longer than a currently set time. When the delay time Td is reduced, the lowermost frequency DF1 of a dip is increased, and when the delay time Td is increased, the lowermost frequency DF1 of a dip is lowered, and therefore, the expansion of a sound image position may be changed as desired by the listener 100.

Incidentally, the prescribed time is determined within the allowable range of the delay time Td, namely, within the range from 62.5 microseconds to 125 microseconds, as described above. Therefore, when the delay time Td is set to, for example, 125 microseconds, even if an instruction for narrowing a sound image position is issued, the set delay time Td is never further increased. In this case, the listener 100 may be informed with an alarm or the like that a sound image position cannot be narrowed any more.

Moreover, the control section 60 may not only change the setting of the delay time but also change various parameters to be set, such as the amplification factor set in the amplifiers 72 and 82 and the degree of the phase adjustment set in the all-pass filters 74 and 84.

Although the comb filters 71 and 81 are comb filters in the aforementioned embodiment, a notch filter, a parametric equalizer or the like may be used to function as a filter for a frequency characteristic with the lowermost frequency of a dip previously set within the frequency range of 4 kHz through 8 kHz.

Although the stereophonic reproducing device 1 is described as the preferred embodiment of the invention in the aforementioned embodiment, the object of the invention may be attained by providing an acoustic processing device having the same configuration as the acoustic processing section 20. Such an acoustic processing device is applicable to various electric equipment having two or more speakers capable of stereophonic reproduction, such as a cellular phone, a television and an AV amplifier.

Although the configuration of the embodiment is described as a hardware configuration, a part of or all of the functions of the acoustic processing section 20 may be realized by a CPU of a computer not shown, which includes the input section 10, the DAC 30, the amplifying section 40 and the speakers 50L and 50R, by executing an acoustic processing program stored in a memory of the computer. Such an acoustic processing program may be provided in a state where it is stored in any of computer-readable recording media, such as magnetic recording media (including a magnetic tape and a magnetic disk), optical recording media (including an optical disk), a magneto-optical recording medium and a semiconductor memory. In this case, a reading section for reading such a recording medium is provided. Alternatively, the program may be downloaded through a network such as the Internet.

The audio signal C is included as the in-phase component in the L-channel audio signal and the R-channel audio signal in the above description, which does not limit the invention. Specifically, the invention is applicable to any acoustic processing device as far as audio signals of a plurality of channels each including an in-phase component are input thereto.

Here, the details of the above embodiments are summarized as follows.

The acoustic processing device of the embodiment includes an input section to which audio signals of a plurality of channels respectively including in-phase components are input, a phase adjusting section that adjusts phases of the audio signals of the plurality of channels respectively to generate phase adjustment signals of the plurality of channels being different in phase from the audio signals of the plurality of channels input to the input section, an anti-phase generating section that generates an anti-phase signal by adding the phase adjustment signals of the plurality of channels to each other and adjusting a phase of the added signal to a substantially inverted phase, and an output section that outputs signals obtained by adding, to each of the audio signals of the plurality of channels input to the input section, the phase adjustment signal of another channel and the anti-phase signal.

By this configuration, a component of a different phase (i.e., an indirect path component) is output from another channel, and hence, good expansion of a sound field may be attained. Furthermore, when an audio signal of each channel and a phase adjustment signal of another channel are added to each other, in-phase components included in the audio signals of the respective channels cancel each other, and hence, the in-phase components are degraded. In contrast, when the in-phase component of the phase adjustment signal of each channel is further added as the anti-phase signal, the degraded in-phase signal is restored. Accordingly, the degradation of the in-phase components included in the audio signals (sound signals) of the plurality of channels is prevented.

Also, the acoustic processing device further includes a filtering section that makes a dip in each of the audio signals of the plurality of channels input to the input section in a range from 4 kHz to 8 kHz and outputs resultant signals to the phase adjusting section.

When a sound having a dip in a range from 4 kHz to 8 kHz in an indirect path component is output from a speaker, a listener definitely feels as if a virtual speaker was localized in a position at an angle of 30° through 60°. Owing to this configuration, since an audio signal for making a listener definitely feel as if a virtual speaker was localized in a position at an angle of 30° through 60° is generated, even if an actual speaker is disposed at an angle smaller than 30° against a front direction of the listener, audio sound capable of making the listener definitely feel as if the speaker was localized in a position expanded from the actual position may be generated. Accordingly, an audio signal for making a listener definitely feel expansion of a sound field may be generated.

Preferably, the filtering section includes a delaying section which delays each of the audio signals of the plurality of channels by a previously set time, and an adding section which outputs signals obtained by adding the audio signals of the plurality of channels delayed by the delaying section and the audio signal of the plurality of channel input to the input section respectively in the same channel.

In this configuration, a dip may be caused in the range from 4 kHz to 8 kHz in each of the audio signals of the respective channels merely by adding the audio signal of a given channel having been delayed by the prescribed time and the audio signal of the same channel to each other. For example, when the sampling frequency is 48 Hz, a dip may be caused at 6 kHz by employing the delay time of merely 4 samples. Accordingly, the complexity of the filtering section is small.

Preferably, the acoustic processing device further includes a compensating section that compensates a dip of a component of the anti-phase signal in each of the signals output by the output section.

When a dip is caused in the range from 4 kHz to 8 kHz in the audio signal of given channel (of, for example, the L-channel) having been input to the input section and the audio signal of another channel (of, for example, the R-channel) having been adjusted in the phase and the anti-phase signal are further added, since the anti-phase signal includes the component of the L-channel having the dip, a dip is caused not only in the audio signal of the R-channel but also in the audio signal of the L-channel. Therefore, when this configuration is employed, the dip caused in the audio signal of the L-channel may be eliminated by compensating the frequency characteristic.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2009-210930 filed on Sep. 11, 2009, the contents of which are incorporated herein by reference.

What is claimed is:

1. An acoustic processing device comprising:

an input section to which audio signals of a plurality of channels respectively including in-phase components are input;

a filtering section that makes a dip in each of the audio signals of the plurality of channels input to the input section in a range of 4 kHz to 8 kHz and outputs filtering-processed audio signals;

a phase adjusting section that adjusts phases of the filtering-processed audio signals of the plurality of channels respectively received from the filtering section to generate phase adjustment signals of the plurality of channels being different in phase from the audio signals of the plurality of channels input to the input section;

an anti-phase generating section that generates an anti-phase signal by adding the phase adjustment signals of the plurality of channels to each other and adjusting a phase of the added signal to a substantially inverted phase; and an output section that outputs signals obtained by adding, to each of the audio signals of the plurality of channels input to the input section, the phase adjustment signal of another channel and the anti-phase signal.

2. The acoustic processing device according to claim 1, wherein the filtering section includes:

a delaying section which delays each of the audio signals of the plurality of channels by a previously set time; and an adding section which outputs signals obtained by adding the audio signals of the plurality of channels delayed by the delaying section and the audio signal of the plurality of channel input to the input section respectively in the same channel.

3. The acoustic processing device according to claim 1, further comprising:

a compensating section that compensates a dip of a component of the anti-phase signal in each of the signals output by the output section.

4. The acoustic processing device according to claim 1, wherein the phase adjusting section adjusts the phases of the audio signals of the plurality of channels respectively with same amount of phase adjustment.

5. The acoustic processing device according to claim 1, wherein the phase adjusting section adjusts the phases of the audio signals of the plurality of channels respectively with different amounts of phase adjustment.

* * * * *